US005292571A

United States Patent [19]

Quinn

[11] Patent Number: 5,292,571

[45] Date of Patent: Mar. 8, 1994

[54] DRAWER DIVIDER

[76] Inventor: Forrest G. Quinn, 13836 Bora Bora, # 326, Marina Del Rey, Calif. 90292

[21] Appl. No.: 796,863

[22] Filed: Nov. 25, 1991

[51] Int. Cl.[5] ..... B32B 3/12

[52] U.S. Cl. ..... 428/178; 428/99; 428/118; 428/120; 428/184; 428/223; 312/348.4; 52/797

[58] Field of Search ..... 428/178, 174, 119, 120, 428/182, 184, 116, 117, 99, 118, 131, 137, 188, 192, 223; 52/797, 795; 5/308; 312/348.4

[56] References Cited

U.S. PATENT DOCUMENTS 3,366,530 1/1968 Kodich ..... 428/116
3,405,659 10/1968 Hees ..... 428/116
3,429,544 2/1969 Williams ..... 428/116
3,755,056 8/1973 McGrew ..... 428/178
4,500,583 2/1985 Naul ..... 428/184
4,957,788 9/1990 Colonel et al. ..... 428/120

*Primary Examiner*—Donald J. Loney
*Attorney, Agent, or Firm*—Robert M. Sperry

[57] ABSTRACT

An improved drawer dividing device comprising a plurality of strips of resilient material fixedly joined at a plurality of locations to form a collapsible grating which can be expanded, as required, to provide a desired number of individually separate storage spaces, yet which is adjustable in size to occupy only the amount of space required for storing the desired number of articles.

7 Claims, 2 Drawing Sheets

DRAWER DIVIDER

BACKGROUND

1. Field of Invention

This invention relates to dividers for dresser drawers and the like and is particularly directed to improved drawer dividers which require minimal storage space, when not in use, and which are readily expandable to separate, retain and organize small articles in all or a desired portion of a drawer.

2. Prior Art

Storage space in dresser drawers and the like is always limited. Furthermore, it is often necessary or desirable to store a plurality of small articles, such as socks, in a given drawer. Unfortunately, when this is done, it is extremely difficult to separate the articles into any semblance of order. Many people simply throw all of their socks into a sock draw loosely. However, this is very unsightly and makes it virtually impossible to find a matching pair among the seemingly endless variety of individual socks. Other people wrap mating socks together into a ball and toss the balls into the sock drawer. This facilitates finding appropriate pairs of socks. However, the sock "balls" tend to roll about, as the drawer is opened and closed, which makes it difficult to keep similarly colored sock balls located in a group and hence to maintain organization within the drawer. At the same time, it may be necessary or desirable to keep other small items in the same drawer. Thus, it may be desirable to keep handkerchiefs or jewelry items, such as tie tacks, cuff links, etc. in the sock drawer. However, when the drawer is opened and closed, the movement causes the items to move about and become intermingled, so that the drawer looks messy and it is difficult to locate desired items within the drawer.

In order to overcome this problem, numerous prior art devices have been proposed. Thus, it has been proposed to provide sock drawers having longitudinal and vertical separating boards permanently installed to provide a plurality of cubicles, each sized to accommodate a single sock ball. Unfortunately, this precludes use of the drawer for virtually any other purpose. Alternatively, it has been proposed to provide one or more boards which can be inserted into pairs of slots formed on opposite sides of the drawer to divide the drawer into two or more areas extending the width of the drawer. Unfortunately, the number of such boards and slots is usually extremely limited, so that the number of separate areas which can be created is equally limited. Furthermore, such boards and slots make no provision for lateral separation. Still others have proposed rectangular grates formed to accommodate a given number of sock balls, for example, a dozen. However, such grates occupy the same amount of drawer space, regardless of whether one, two four or a full dozen pairs of socks are stored therein. Thus, unless the grate is substantially full, a considerable amount of drawer space is occupied, unnecessarily, by the grate itself. Thus, none of the prior art drawer dividing means have been entirely satisfactory.

BRIEF SUMMARY AND OBJECT OF INVENTION

These disadvantages of the prior art are overcome with the present invention and an improved drawer divider is provided which does not require permanent installation and yet can effectively maintain separation and organization for substantially any desired number of articles in a given drawer and which can be adjusted in size to occupy only the amount of space required for the desired number of articles.

The advantages of the present invention are preferably attained by providing an improved drawer dividing device which is removably insertable in a drawer and which comprises a plurality of strips of resilient material fixedly joined at a plurality of locations to form a collapsible grating which can be expanded, as required, to provide a desired number of individually separate storage spaces, yet which is adjustable in size to occupy only the amount of space required for storing the desired number of articles.

Accordingly, it is an object of the present invention is to provide an improved drawer dividing device.

Another object of the present invention is to provide an improved drawer dividing device which does not require permanent installation and yet can effectively maintain separation and organization for substantially any desired number of articles in a given drawer.

An additional object of the present invention is to provide an improved drawer dividing device which can be adjusted in size to occupy only the amount of space required for the desired number of articles.

A specific object of the present invention is to provide an improved drawer dividing device comprising a plurality of strips of resilient material fixedly joined at a plurality of locations to form a collapsible grating which can be expanded, as required, to provide a desired number of individually separate storage spaces, yet which is adjustable in size to occupy only the amount of space required for storing the desired number of articles.

These and other objects and features of the present invention will be apparent from the following detailed description, taken with reference to the figures of the accompanying drawing.

DETAILED DESCRIPTION OF THE INVENTION

Figure 1:
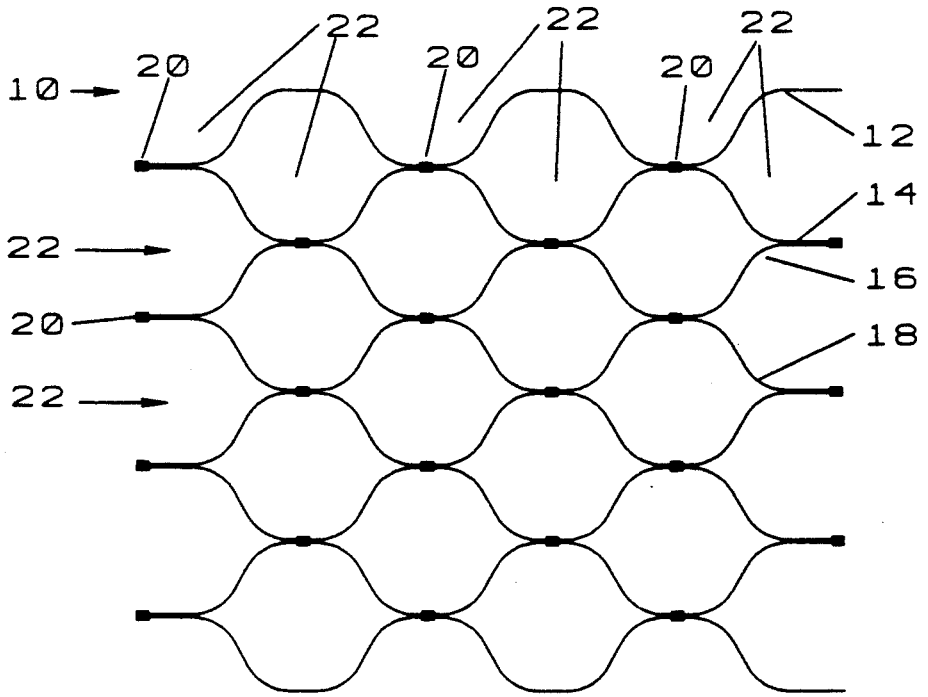
FIG. 1 is a plan view of a drawer dividing device embodying the present invention.
Figure 3:
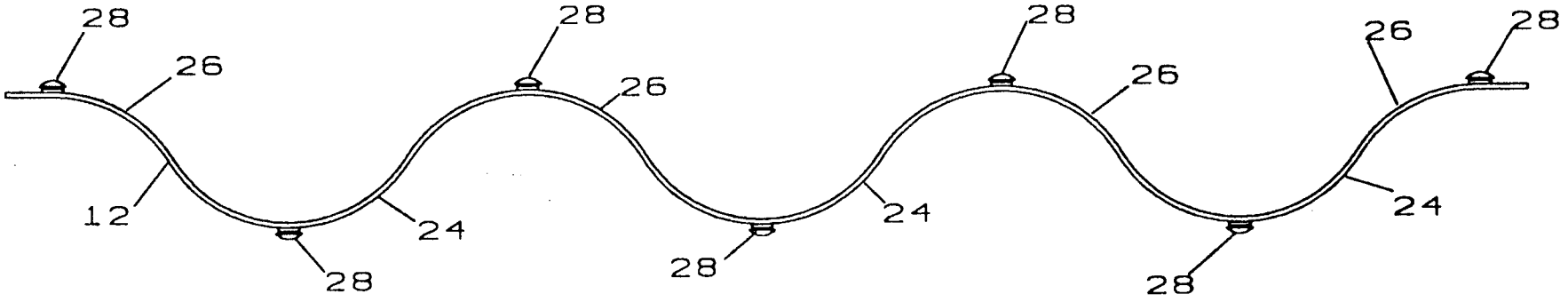
FIG. 3 is a top view of one of the sheets forming the drawer dividing device of FIG. 1.
Figure 4:
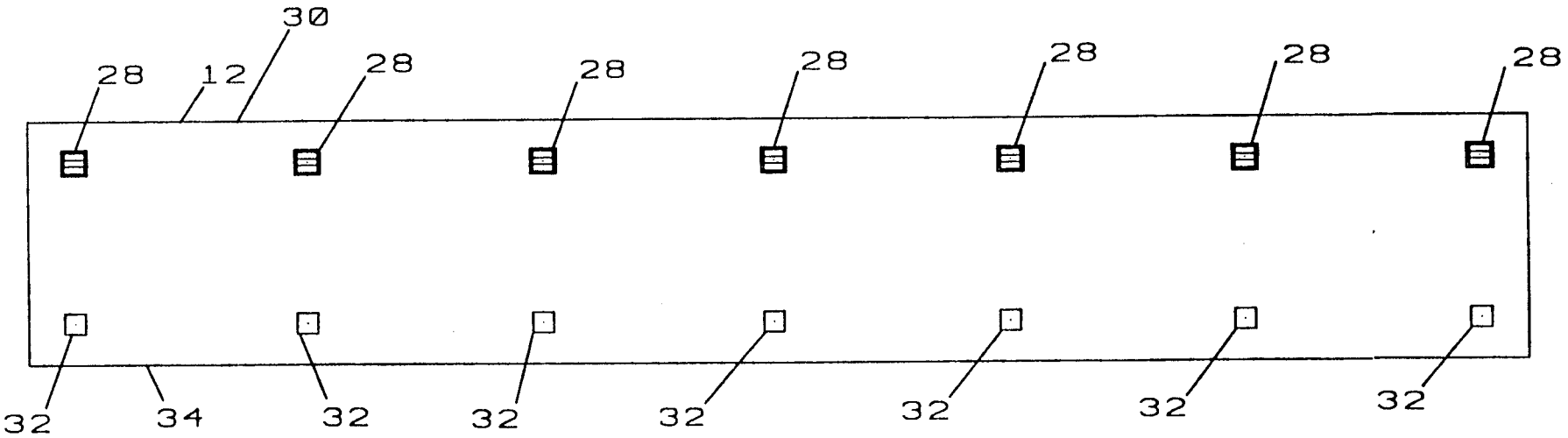
FIG. 4 is a side view of the drawer divider sheet of FIG. 3.

In that form of the present invention chosen for purposes of illustration in the drawing, FIG. 1 shows a drawer dividing device, indicated generally at 10, comprising a plurality of sheets 12, 14, 16 and 18 formed of resilient material, such as metal, plastic, rubber or the like, which are each connected to one or more adjacent sheets at spaced intervals, as indicated at 20, by suitable means such as studs, rivets, adhesive and the like, to define a plurality of individual generally hexagonal or sinusoidal storage spaces 22 therebetween for receiving articles to be stored. Preferably, the sheets 12, 14, 16 and 18 are identical to each other, as best seen in FIGS. 3 and 4, and are connected together, as described. Because the sheets 12, 14, 16 and 18 are connected in this manner and are resilient, they form a structure, defining the drawer dividing device 10, which is flexible and which can be made substantially flat for storage, when not needed, or which can be expanded to fill all or any desired portion of a drawer, as appropriate. Furthermore, since the individual storage spaces 22 are hexagonal or sinusoidal in shape, they provide maximum utilization of the available space. Although the drawer dividing device 10 has been shown formed of four sheets 12, 14, 16 and 18, it will be apparent that, if desired, one or more additional sheets could be added, connected in the manner shown, to form substantially any desired sized version of the drawer dividing device 10.

Figure 2:
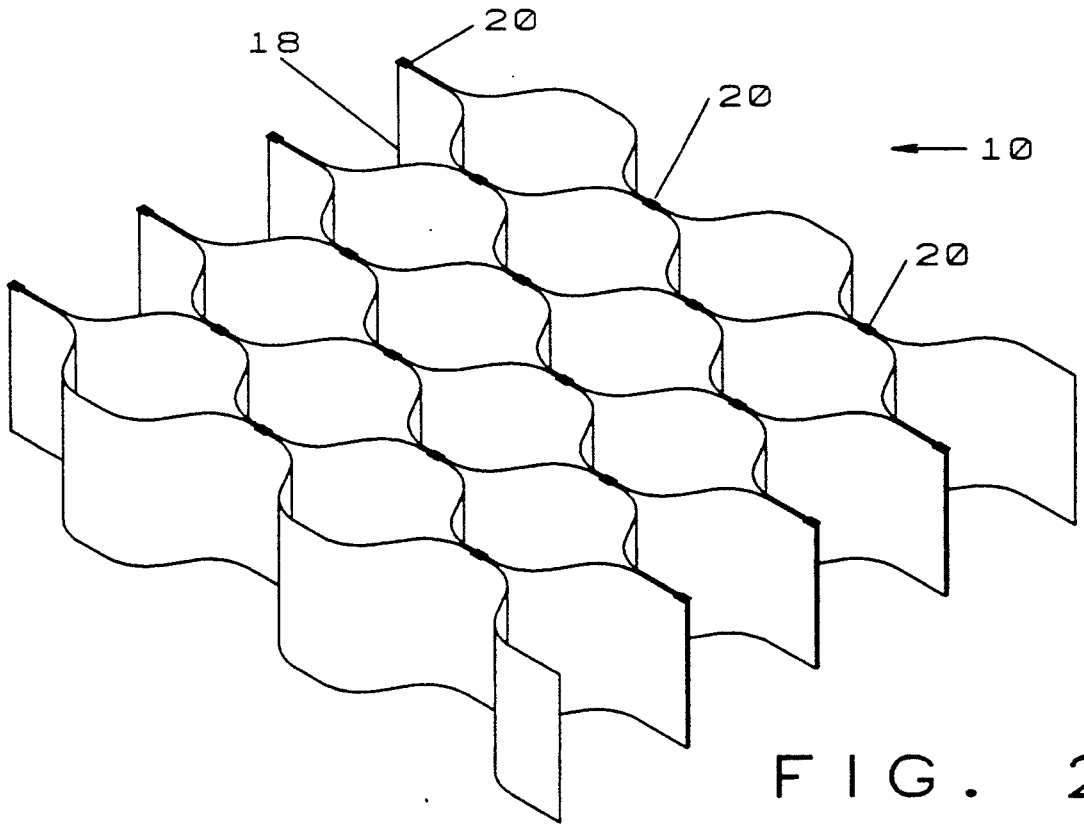
FIG. 2 is an isometric view of the drawer dividing device of FIG. 1.

FIGS. 3 and 4 show the structure of the sheets 12, 14, 16 and 18. Using sheet 12 as an example, since the sheets 12, 14, 16 and 18 are identical, it is seen that each of the sheets 12 is generally snake-like strip of material. As shown, the sheet 12 is formed with a sinusoidal curve having forwardly extending portions 24 interposed between rearwardly extending portions 26. However, it will be understood that, if desired, the portions 24 and 26 could be formed as three-sided curves, so that each of the portions 24 and 26 would define one half of a hexagon. Studs 28 project outwardly from the apeces of the portions 24 and 26 and are located adjacent one edge 30 of the sheet 12, while a plurality of openings 32 are provided in the apeces of the portions 24 and 26 adjacent the opposite edge 34. Thus, by inverting the alternate sheets 14 and 18, the studs 28 of each of the sheets 12, 14, 16 and 18 will mate with the openings 32 of an adjacent sheet to form the drawer dividing device 10 of FIGS. 1 and 2. Thus, as seen in FIGS. 1 and 2, the studs 28 on portions 26 of sheet 14 will engage the openings 32 in the adjacent portions 24 of the sheet 12, while the studs 28 on portions 26 of sheet 16 will engage the openings 32 in the portions 24 of sheet 14. Similarly, the studs 28 on the portions 26 of sheet 18 will engage the openings 32 in the portions 24 of sheet 16 to form the drawer dividing device 10 of FIGS. 1 and 2.

In use, the drawer dividing device 10 can be disassembled to lie substantially flat, when not in use, and, when needed, can be placed in a drawer and opened partially or completely, as needed, to provide a desired number of individual storage spaces 22. If all of the possible storage spaces 22 provided by the drawer dividing device are not filled, the sheets defining the unused storage spaces will lie substantially flat or may be removed. Thus, the drawer dividing device 10 will not occupy any unused portion of the drawer and this unused portion of the drawer will be available for articles which do not require the individual storage spaces 22. If additional articles needing individual storage are presented, the sheets 12, 14, 16 and 18 of the drawer dividing device 10 are simply expanded to provide the required additional storage spaces 22 or, if appropriate, additional sheets, such as sheets 12, 14, 16 and 18, may be added to the drawer dividing device 10. Alternatively, if some of the articles are removed from the storage spaces 22, the adjacent sheets 12, 14, 16 or 18, because of their resilience, will simply fold to lie against the adjacent sheets defining occupied storage spaces 22 or may be disconnected for storage in a more convenient location. Thus, the area of the drawer occupied by the drawer dividing device 10 will vary, as required, to accommodate the articles needing individual storage and will leave unneeded portions of the drawer available for other uses.

Obviously, numerous variations and modifications can be made without departing from the spirit of the present invention. Therefor, it should be clearly understood that the form of the present invention described above and shown in the figures of the accompanying drawing are illustrative only and are not intended to limit the scope of the present invention.

What is claimed is:

1. A drawer dividing device comprising:

a plurality of independent sheets formed of resilient material with each of said sheets connected to an adjacent one of said sheets at spaced intervals to define a plurality of individual storage spaces therebetween and wherein 6 said sheets are undulating in a sinusoidal manner. having forwardly and rearwardly extending portions with studs projecting outwardly from the apices of each of said forwardly and rearwardly expending portions along one edge of said sheets, and openings mateable with said studs formed in the apices of each of said forwardly and rearwardly extending portions adjacent a second edge of said sheets to provide said sheets with a releasable connection.

2. The drawer dividing device of claim 1 wherein:

said sheets may be stored against an adjacent sheet to allow unneeded portions of said drawer dividing device to occupy minimal space in a drawer.

3. The drawer dividing device of claim 1 wherein:

said sheets may be individually removed for storage.

4. The drawer dividing device of claim 1 wherein:

said device may be folded substantially flat for storage.

5. The drawer dividing device of claim 1 wherein:

said individual storage spaces are generally hexagonal.

6. The drawer dividing device of claim 1 wherein:

said sheets are mirror images of each other.

7. The drawer dividing device of claim 1 wherein:

each of said sheets is formed with a plurality of forwardly and rearwardly extending portions each formed to define one half of a hexagon.

* * * * *